US005552033A

United States Patent [19]

Shih

[11] Patent Number: 5,552,033

[45] Date of Patent: Sep. 3, 1996

[54] INTEGRATED PROCESS FOR INCREASING $C_6$ TO $C_8$ AROMATICS CONTENT IN REFORMATE PREPARED FROM $C_9^+$ AROMATICS-CONTAINING FEED

[75] Inventor: Stuart S. Shih, Cherry Hill, N.J.

[73] Assignee: Mobil Oil Corporation, Fairfax, Va.

[21] Appl. No.: 347,732

[22] Filed: Dec. 1, 1994

[51] Int. Cl.[6] ..... C10G 45/00; C10G 59/02; C10G 69/08

[52] U.S. Cl. ..... 208/89; 208/58; 208/60; 208/64; 208/65; 208/96; 208/134

[58] Field of Search ..... 208/58, 60, 64, 208/65, 96, 89, 134

[56] References Cited

U.S. PATENT DOCUMENTS

| | | | |
|---|---|---|---|
| 4,206,035 | 6/1980 | Hutson, Jr. et al. | 208/65 |
| 4,927,521 | 5/1990 | Chu | 208/65 |
| 5,298,150 | 3/1994 | Fletcher et al. | 208/89 |
| 5,320,742 | 6/1994 | Fletcher et al. | 208/89 |
| 5,346,609 | 9/1994 | Fletcher et al. | 208/89 |
| 5,362,376 | 11/1994 | Shih et al. | 208/89 |
| 5,396,010 | 3/1995 | Harandi et al. | 585/322 |
| 5,411,658 | 5/1995 | Chawla et al. | 208/89 |
| 5,413,696 | 5/1995 | Fletcher et al. | 208/89 |
| 5,413,697 | 5/1995 | Fletcher et al. | 208/89 |
| 5,413,698 | 5/1995 | Fletcher et al. | 208/89 |

FOREIGN PATENT DOCUMENTS 1254185 11/1971 United Kingdom ..... 208/60

OTHER PUBLICATIONS

Meyers, Robert, "Handbook of Petroleum Refining Processes", 1986, pp. 3–14–3–17. (No month).

*Primary Examiner*—Anthony McFarlan
*Assistant Examiner*—Walter D. Griffin
*Attorney, Agent, or Firm*—Ronald A. Bleeker; Dennis P. Santini

[57] ABSTRACT

An integrated process for increasing $C_6$ to $C_8$ aromatics content in reformate prepared from $C_9^+$ aromatics-containing feed comprises:

1) pretreating a raw naphtha feedstream containing $C_9^+$ aromatics and sulfur by contacting with a) a hydrodesulfurization catalyst under hydrodesulfurization conditions to produce a hydrodesulfurized feedstream and thereafter b) cascading said hydrodesulfurized feedstream over a noble metal- and/or Group VIA metal-containing porous crystalline inorganic oxide catalyst comprising pores having openings of 12-member rings under conditions sufficient to effect conversion of $C_9^+$ aromatics, thereby providing a pretreated effluent stream of enhanced $C_8^-$ aromatics content relative to that obtained in the absence of said cascading; and 2) reforming at least a portion of said pretreated effluent stream to provide a reformate stream.

17 Claims, 1 Drawing Sheet

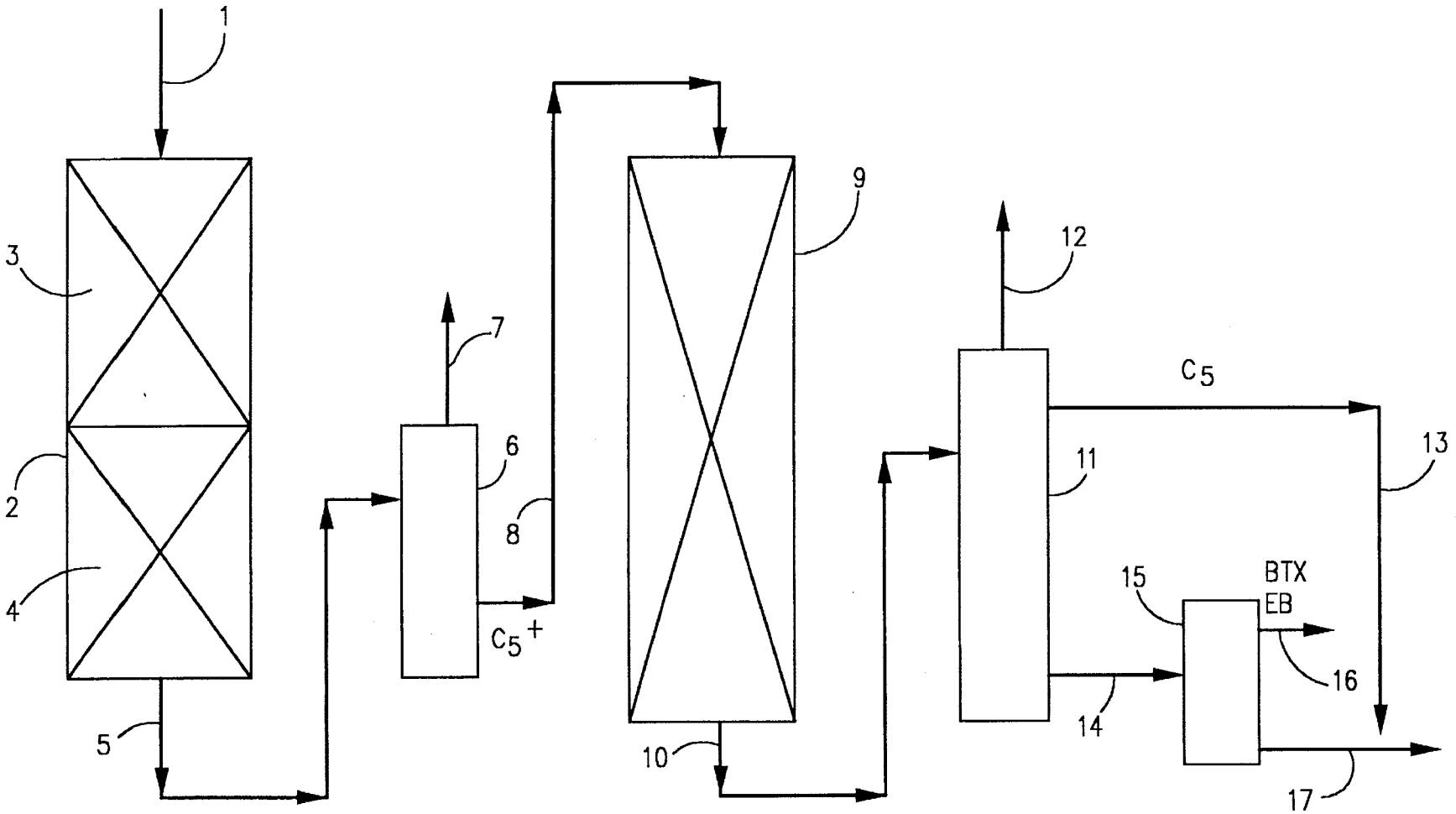
1
2
3
4
5
6
7
8
$C_5^+$
9
10
11
12
13
$C_5$
14
15
16
BTX
EB
17

INTEGRATED PROCESS FOR INCREASING $C_6$ TO $C_8$ AROMATICS CONTENT IN REFORMATE PREPARED FROM $C_9^+$ AROMATICS-CONTAINING FEED

RELATED APPLICATIONS

This application is related in subject matter to U.S. patent application Ser. No. 08/347,733, filed concurrently, entitled INTEGRATED PROCESS FOR THE PRODUCTION OF REFORMATE HAVING REDUCED BENZENE CONTENT.

BACKGROUND OF THE INVENTION

This invention relates to a process for increasing the production of benzene, toluene, and xylenes (BTX) and ethylbenzene from a $C_9^+$ aromatics-containing naphtha by a modified pretreatment of raw naphtha. The process also permits a reformer to process heavier naphthas, including FCC heavy gasoline and coker naphtha.

$C_9^+$ aromatics are found in heavy naphthas, e.g., FCC heavy gasoline, and coker heavy naphtha. Restrictions on the content of these heavy aromatics in gasolines will result from proposed end boiling point limits of gasoline fuels, referred to as T90 or (90 vol % temperature). T90 limits curtail the presence of hydrocarbon components that boil above temperatures in a range of 350° to 430° F. $C_6$ to $C_8$ aromatics include BTX (benzene, toluene, and xylenes), as well as EB (ethylbenzene). Inasmuch as the $C_6$ to $C_8$ aromatics have a higher value commercially than $C_9^+$ aromatics, the conversion of $C_9^+$ aromatics in heavy naphthas to $C_6$ to $C_8$ aromatics is highly desirable.

$C_6$ to $C_8$ aromatics contribute to the octane rating of the gasoline pool in a refinery, and are commonly produced in refinery processes such as catalytic reforming which have been a part of the conventional refinery complex for many years. However, recent concerns about volatility and toxicity of hydrocarbon fuel and the resultant environment damage has prompted legislation that limits the content and composition of aromatic hydrocarbons in such fuels. Some of these limitations relate specifically to benzene which, due to its toxicity, will be substantially eliminated from the gasoline pool.

However, because $C_6$ to $C_8$ aromatics are commercially desirable petrochemicals, it would be desirable to provide a process for reforming lower value heavy naphtha feedstocks which produces low aromatics content gasoline, as well as $C_6$ to $C_8$ aromatics which can be thereafter extracted from the reformate product.

Reformates can be prepared by conventional techniques by contacting any suitable material such as a naphtha charge material boiling in the range of $C_5$ or $C_6$ up to about 380° F. (193° C.) with hydrogen in contact with any conventional reforming catalyst.

U.S. Pat. No. 4,927,521 to Chu, incorporated herein by reference, discloses a process for pretreating naphtha prior to reforming, by contacting with a zeolite catalyst, e.g., zeolite beta, containing at least one noble metal and at least one alkali metal, for the purpose of producing higher yields of $C_4^+$ and $C_5^+$ gasolines.

U.S. Pat. No. 5,320,742 to Fletcher, et al., incorporated herein by reference, discloses a process for upgrading a higher boiling sulfur-containing catalytically cracked naphtha by hydrodesulfurization followed by contact with an intermediate pore zeolite, e.g., zeolite beta, under conditions which crack low octane paraffins to form higher octane lighter paraffins and olefins.

SUMMARY OF THE INVENTION

The present invention relates to an integrated process for increasing $C_6$ to $C_8$ aromatics content in reformate prepared from $C_9^+$ aromatics-containing feed which comprises:

1) pretreating a raw naphtha feedstream containing $C_9^+$ aromatics and sulfur by contacting with a) a hydrodesulfurization catalyst under hydrodesulfurization conditions to produce a hydrodesulfurized feedstream and thereafter b) cascading said hydrodesulfurized feedstream over a noble metal- and/or Group VIA metal-containing porous crystalline inorganic oxide catalyst comprising pores having openings of 12-member rings under conditions sufficient to effect conversion of $C_9^+$ aromatics, thereby providing a pretreated effluent stream of enhanced $C_8^-$ aromatics content relative to that obtained in the absence of said cascading; and 2) reforming at least a portion of said pretreated effluent stream to provide a reformate stream.

The present invention can be described more particularly as the above integrated process for providing a gasoline boiling range reformate-containing product produced from naphtha further comprising:

3) distilling said reformate stream to provide a $C_1$ to $C_4$ hydrocarbon-containing overhead stream, a $C_5$ hydrocarbon stream and a $C_6^+$ reformate bottoms stream;

4) extracting said $C_6^+$ reformate bottoms stream to provide a $C_6$ to $C_8$ aromatics-containing extract stream and a $C_6^+$ raffinate stream containing $C_6$ to $C_8$ non-aromatics and $C_{p+}$ aromatics; and 5) combining said $C_5$ hydrocarbon stream with said $C_6^+$ raffinate stream to provide a gasoline boiling range product.

The present invention relates to a process wherein a raw naphtha feed is pretreated to convert back-end materials ($C_9^+$) into lighter naphtha in an existing naphtha pretreater used for hydrodesulfurization. The process employs a noble metal- and/or Group VIA-promoted porous inorganic oxide catalyst downstream of the hydrodesulfurization catalyst.

Inasmuch as noble metal promoted catalysts are generally sensitive to hydrogen sulfide poisoning which strongly inhibits hydrogenation activity of the noble metal, the ability of the noble metal-containing catalyst to retain its hydrogenation activity while contacting the $H_2S$-containing effluent from the hydrodesulfurization step is unexpected.

DESCRIPTION OF THE FIGURE

The FIGURE is a process flow diagram depicting a preferred multistage embodiment of the present invention wherein raw naphtha is pretreated in two stages prior to stripping, reforming of the $C_5^+$ stripper bottoms, fractionating the reformate to provide a $C_4^-$ overhead, a $C_5$ hydrocarbon stream, and a $C_6^+$ bottoms stream from which is extracted BTX, and combining the $C_5$ hydrocarbon stream with the aromatic $C_6^+$ bottoms raffinate to provide a combined gasoline boiling range product.

DETAILED DESCRIPTION OF THE INVENTION

Feed

The raw naphtha feedstream can comprise a mixture of aromatic and paraffin hydrocarbons having boiling points about 1.5 to 5.0 or higher mole percent benzene. It can also contain various $C_7$ to $C_{10}$ aromatic hydrocarbons including toluene and aromatic $C_8$ to $C_{10}$ hydocarbons. The feedstream can also contain $C_4$ to $C_6$ paraffinic hydrocarbons including butane, isopentane, isohexane and n-hexane which are normally present at a concentration above 5.0 mole percent. $C_7$ to $C_9$ paraffinic hydrocarbons such as isoheptane and isooctane can also be present. The exact composition of the raw naphtha feedstream will depend on its source. It may be formed by blending all or a portion of the effluent of several different petroleum processing units. Two such effluents are the bottoms product of the stripper column used in FCC gas concentration units and stabilized reformates which contain $C_6$ to $C_9$ aromatic hydrocarbons.

The raw naphtha contains sulfur. Products of catalytic cracking usually contain sulfur impurities which normally require removal, usually by hydrotreating, in order to comply with the relevant product specifications. These specifications are expected to become more stringent in the future, possibly permitting no more than about 300 ppmw sulfur in motor gasolines. As a practical matter, the sulfur content will exceed 50 ppmw and usually will be in excess of 100 ppmw and in most cases in excess of about 500 ppmw. For the fractions which have 95 percent points over about 380° F. (193° C.), the sulfur content may exceed about 1,000 ppmw and may be as high as 4,000 or 5,000 ppmw or even higher, as shown below. The nitrogen content is not as characteristic of the feed as the sulfur content and is preferably not greater than about 20 ppmw although higher nitrogen levels typically up to about 50 ppmw may be found in certain higher boiling feeds with 95 percent points in excess of about 380° F.(193° C.). The nitrogen level will, however, usually not be greater than 250 or 300 ppmw.

The raw naphtha feed to the process comprises a sulfur- and $C_9^+$ aromatics-containing petroleum fraction which boils in the gasoline boiling range. Feeds of this type include light naphthas typically having a boiling range of about $C_6$ to 330° F., full range naphthas typically having a boiling range of about $C_5$ to 420° F., heavier naphtha fractions boiling in the range of about 260° F. to 412° F., or heavy gasoline fractions boiling at, or at least within, the range of about 330° to 500° F., preferably about 330° to 412° F. The present invention is suited to use with feeds containing at least 10 wt % $C_9^+$ aromatics, preferably at least 15 wt % $C_9^+$ aromatics, e.g., 19 wt % $C_9^+$ aromatics.

The raw naphtha may be obtained from straight run distillation or from a coker or FCC unit. Alternatively, pyrolysis gasoline may be used as well. However, diene-containing streams should be treated to reduce or remove sources of gumming, as necessary.

Process Configuration

Referring to the FIGURE, the raw naphtha feedstream 1 containing sulfur compounds, nitrogen compounds, benzene and $C_9^+$ aromatics is passed to a pretreater 2 where it is first treated in a first hydrotreating zone 3 by contacting the feed with a hydrotreating catalyst, which is suitably a conventional hydrotreating catalyst, such as a combination of a Group VI and a Group VIII metal on a suitable refractory support such as alumina, e.g., Co/Mo on alumina, under hydrotreating conditions, i.e., at elevated temperature and somewhat elevated pressure in the presence of a hydrogen atmosphere. More specifically such conditions include temperatures of 400° to 850° F. (220° to 454° C.), preferably 500° to 800° F. (260° to 427° C.) with the exact selection dependent on the desulfurization desired for a given feed and catalyst. These temperatures are average bed temperatures and will, of course, vary according to the feed and other reaction parameters including, for example, hydrogen pressure and catalyst activity. Low to moderate pressures may be used, typically from 50 to 1500 psig (445 to 10443 kPa), preferably 300 to 1000 psig (2170 to 7000 kPa). Pressures are total system pressure, reactor inlet. Pressure will normally be chosen to maintain the desired aging rate for the catalyst in use. The space velocity for the hydrodesulfurization step overall is typically 0.5 to 10 LHSV ($hr^{-1}$), preferably 1 to 6 LHSV ($hr^{-1}$), based on the total feed and the total catalyst volume although the space velocity will vary along the length of the reactor as a result of the stepwise introduction of the feed. The hydrogen to hydrocarbon ratio in the feed is typically about 500 to 5000 scfb (90 to 900 $nll^{-1}$), usually about 1000 to 2500 scfb (180 to 445 $nll^{-1}$) again based on the total feed to hydrogen volumes.

The conditions in the hydrotreating zone should be adjusted not only to obtain the desired degree of desulfurization but to produce the required inlet temperature for the second step of the process so as to promote the desired $C_9^+$ conversion reactions.

Under these conditions, at least some of the sulfur is separated from the feed molecules and converted to hydrogen sulfide, to produce a hydrotreated product and hydrogen sulfide. One suitable family of catalysts which has been widely used for this service is a combination of a Group VIII and a Group VI element, such as cobalt and molybdenum, on a suitable substrate, such as alumina.

The hydrodesulfurized effluent from the first pretreater zone is cascaded to a second pretreater zone 4 which contains a noble metal-containing porous inorganic oxide catalyst having pore openings of 12-member rings. Such porous inorganic oxides have pore windows framed by 12 tetrahedral members and include but are not limited to zeolites selected from the group consisting of zeolite beta, zeolite L, zeolite X, ZSM-12, ZSM-18, ZSM-20, mordenite and boggsite, zeolite beta being preferred. Faujasites such as Rare Earth Y (REY), Dealuminized Y (DAY), Ultrastable Y (USY), Rare Earth Containing Ultrastable Y (RE-USY), Si-Enriched Dealuminized Zeolite Y (LZ-210) (disclosed in U.S. Pat. Nos. 4,711,864, 4,711,770 and 4,503,023, all of which are incorporated herein by reference) are also suited to use in the present invention.

The catalyst can contain from 0.1 to 1 wt %, preferably from 0.3 to 0.7 wt %, Group VI metal and/or noble metal selected from the group consisting of platinum, palladium, iridium, rhodium and ruthenium. Platinum is preferred as well as combinations of platinum and palladium which are resistant to sulfur poisoning.

The noble metal component, where present, is preferably dispersed on the catalyst to provide a H/noble metal ratio of at least 0.8 as measured by hydrogen chemisorption, preferably at least 1.0 H/Pt metal ratio. The hydrogen chemisorption technique indicates the extent of noble metal agglomeration of a catalyst material. Details of the analytical technique may be found in Anderson, J. R., Structure of Metallic Catalyst, Chapter 6, p. 295, Academic Press (1975). In general, hydrogen chemisorbs selectively on the metal so that a volumetric measurement of hydrogen capacity counts the number of metal adsorption sites. Preferably the noble metal-containing catalyst has an alpha value higher than 100 and is unsteamed. The high acidity permits operation at lower temperatures so as to minimize thermodynamic constraints on benzene saturation. Alpha value, or alpha number, is a measure of zeolite acidic functionality and is more fully described together with details of its measurement in U.S. Pat. No. 4,016,218, *J. Catalysis,* 6, pp. 278–287 (1966) and *J. Catalysis,* 61, pp. 390–396 (1980).

Process conditions in the second reaction zone depend on zeolite catalyst activity and feed composition. The $C_9^+$ aromatics conversion should be limited to no more than 50%, preferably less than 40%, in order to avoid loss of aromatics and excess hydrogen consumption. The total pressure and hydrogen partial pressure can be in the range of those used in conventional naphtha pretreating processes, e.g. 100–800 psig, preferably 150–600 psig total pressure. Total pressure (or hydrogen partial pressure) can be higher if more benzene saturation is desired. More specifically such conditions for the second pretreating zone include those which provide for conversion of $C_9^+$ aromatics to lighter aromatics, e.g., by dealkylation. Typically, temperatures of 400° to 1000° F., preferably 500° to 800° F. These temperatures are average bed temperatures and will, of course, vary according to the feed and other reaction parameters including, for example, hydrogen pressure and catalyst activity. A convenient mode of operation is to cascade the hydrotreated effluent into the second reaction zone and this will imply that the outlet temperature from the first step (hydrodesulfurization) will set the initial temperature for the second step. Thus, the process can be operated in an integrated manner. Typically, pressures from 100 to 800, preferably 150 to 600 psig total pressure are used. Pressures are total system pressure, reactor inlet. Pressure will normally be chosen to maintain the desired aging rate for the catalyst in use. The space velocity for the hydrodesulfurization step overall is typically 0.5 to 10 LHSV, preferably 1 to 6 LHSV, based on the total feed and the total catalyst volume although the space velocity will vary along the length of the reactor as a result of the stepwise introduction of the feed. The hydrogen circulation rate in the feed is typically about 500 to 5000 scf/b, usually about 1000 to 4000 scf/b, again based on the total feed to hydrogen volumes.

The hydrodesulfurization catalyst and the inorganic oxide catalyst of the second reaction zone can be loaded either in the same reactor or in separate reactors operating in a cascade mode without interstage separation.

The effluent 5 from the second pretreater zone 4 is passed to a stripper 6 wherein ammonia, hydrogen sulfide and $C_1$ to $C_4$ hydrocarbons are stripped off as overhead 7. The stripper bottoms 8 are passed to a reformer 9.

Reforming operating conditions include temperatures in the range of from about 800° F. (427° C.) to about 1000° F. (538° C.), preferably from about 890° (477° C.) up to about 980° F. (527° C.), liquid hourly space velocity in the range of from about 0.1 to about 10, preferably from about 0.5 to about 5; a pressure in the range of from about atmospheric up to about 700 psig (4900 Kpa) and higher, preferably from about 100 (700 kPa) to about 500 psig (4200 Kpa); and a hydrogen-hydrocarbon ratio in the charge in the range from about 0.5 to about 20 and preferably from about 1 to about 10. For maximizing BTX and EB production, continuous catalytic reforming (CCR) is preferred over fixed-bed reformer.

The reformer effluent 10 is passed to a distillation unit 11 wherein $C_1$ to $C_4$ hydrocarbons 12 are taken off as overhead and a $C_5$ hydrocarbon stream 13 is removed. The reformer effluent 14 is then passed to an extractor 15 wherein a BTX and EB stream 16 is extracted. The raffinate 17 is combined with the $C_5$ hydrocarbon stream 15 to provide a combined gasoline boiling range product.

The following example is provided to illustrate the invention.

EXAMPLE

Two zeolite beta catalysts were evaluated under conditions compatible with conventional naphtha pretreating processes. The zeolite catalysts were evaluated in a hydrodesulfurization(HDS)/zeolite catalyst system using a commercial CoMo/Al203 catalyst as the desulfurization catalyst. The experiments were conducted in a fixed-bed, down-flow, dual reactor pilot unit. The commercial HDS catalyst was loaded in the first reactor and the zeolite-containing catalyst downstream in a second reactor in a ½ volumetric HDS/zeolite catalyst ratio. The pilot unit was operated in a cascade mode without interstate separation to remove zeolite catalyst poisoning ammonia and hydrogen sulfide from the first reactor effluent. The normal operating conditions were 4.0 LHSV over HDS catalyst, 2.0 LHSV over zeolite catalyst, 4000 scf/bbl of hydrogen circulation rate, and 550 psig total pressure. The HDS catalyst was kept at a constant 650° F. while the zeolite temperature was varied from 400°–775° F. to obtain a wide range of conversion conditions. Table 1 lists properties of the two naphtha feeds used in the experiments.

Some impurities in the feed such as hydrogen sulfide, ammonia and organic nitrogen and sulfur compounds will deactivate the catalyst. Accordingly, feed pretreating in the form of hydrotreating is usually employed to remove these materials. Typically feedstock and reforming products or reformate have the following analysis set out in Table 1 below:

TABLE 1

| | FEED A | FEED B |
|---|---|---|
| API Gravity, °API | 54.2 | 56.4 |
| Hydrogen, wt % | 14.27 | 14.45 |
| Sulfur, ppmw | 500 | 5600 |
| Nitrogen, ppmw | 10 | 28 |
| $C_6$ Aromatics, wt. % | 1.4 | 1.3 |
| $C_7$ Aromatics, wt. % | 4.2 | 2.7 |
| $C_8$ Aromatics, wt. % | 5.2 | 4.8 |
| $C_9$ Aromatics, wt. % | 18.5 | 16.3 |
| Distillation (D2887), °F. | | |
| IBP | −1 | 66 |
| 10% | 135 | 148 |
| 50% | 244 | 253 |
| 90% | 402 | 358 |
| EBP | 534 | 428 |

Catalysts

Two catalysts were evaluated in the second pretreatment zone and their properties are set out in Table 2 below. Catalyst A was an unsteamed Pt/Beta/alumina catalyst and Catalyst B was a steamed Mo/Beta/alumina catalyst used for comparative purposes.

TABLE 2

| | Catalyst A | Catalyst B |
|---|---|---|
| Zeolite, wt % | 65 | 65 |
| Alumina, wt % | 35 | 35 |
| Platinum, wt % | 0.5 | — |
| Molybdenum, wt % | — | 3.6 |
| Alpha* | 350 | 110 |
| Surface Area*, $m^2/g$ | 459 | 422 |
| n-$C_6$ Sorption, cc/g | 14.7 | 13.9 |
| H/Pt | 0.83 | — |

*Prior to metal addition

Feed-A Naphtha

Feed-A naphtha was examined using both Catalyst-A and Catalyst-B.

HDS/HDC Performance

The pretreater performance comparisons are summarized in Table 3 below. As shown in Table 3, the HDS/HDC catalyst system increased $C_9^+$ aromatics conversion as compared to the HDS alone case. In addition, Catalyst-A achieved >40% $C_9^+$ aromatics conversion at temperatures above 550° F. while Catalyst-B required temperatures higher than 750° F. Under these conditions, chemistry for the $C_9^+$ aromatics conversion may involve hydrogenation, hydrocracking, ring-opening, and side-chain dealkylation reactions. The Pt-promoted catalyst may be more active than the Mo-promoted catalyst for hydrogenation and hydrocracking reactions.

TABLE 3

| | Feed | HDS only | Catalyst-A | | Catalyst-B | |
|---|---|---|---|---|---|---|
| Zeolite Temp., °F. | — | — | 550° F. | 583° F. | 600° F. | 750° F. |
| Process Yield, wt. % | | | | | | |
| $C_6$ Cyclo-$C_5$ | 0.1 | 0.1 | 0.1 | 0.1 | 0.1 | 0.1 |
| Cyclo-$C_6$ | 2.4 | 2.7 | 3.7 | 1.9 | 2.7 | 1.8 |
| $C_6A$ | 1.4 | 1.5 | 0.1 | <0.01 | 1.6 | 1.7 |
| $C_7A$ | 4.2 | 4.1 | 1.6 | 0.1 | 4.1 | 4.3 |
| $C_8A$ | 5.2 | 5.3 | 3.9 | 1.2 | 5.3 | 5.6 |
| $C_9^+A$ | 18.5 | 18.8 | 10.7 | 1.8 | 14.8 | 10.4 |
| $C_9^+A$ Conversion, % | — | −2 | 42 | 90 | 20 | 43 |
| 300° F.$^+$ Conv., % | — | 4.6 | 32 | 91 | 20 | 43 |

Furthermore, Catalyst-A was found to be very active for the conversion of the 300° F.$^+$ bottoms. This unique activity allows continuous catalytic reforming (CCR), or fixed-bed reformer to process heavier feed, particularly for feeds rich in heavy aromatics, such as heavy FCC gasoline and heavy coker naphtha.

Integration With Reformer

The impact of reforming $C_5^+$ raffinate was examined based on kinetic models that simulate commercial semi-regenerable fixed-bed reforming performance and continuous catalytic reforming (CCR) performance. The reforming simulations were set at conditions to produce $C_5^+$ reformates with an octane of 100 R+O. Table 4 illustrates the reforming performances of the Catalyst-A systems. As shown in Table 4, reforming significantly increased aromatics yields, including BTX and EB, as expected. The HDS/Catalyst-A pretreating case produced more BTX and EB at 42% $C_9^+$ aromatics conversion (or 32% 300° F.$^+$ conversion) than the conventional HDS pretreating case. The BTX and EB yields declined at more severe conditions. For this particular naphtha, Catalyst-B produced less BTX and EB than the HDS alone.

TABLE 4

HDS/Zeolite/Reforming Integration

| | Semi-Regenerable | | | CCR | | |
|---|---|---|---|---|---|---|
| | HDS | HDS/Zeolite | | HDS | HDS/Zeolite | |
| Pretreater Conditions | | | | | | |
| Zeolite Temp., °F. | — | 550 | 583 | — | 550 | 583 |
| 300° F.$^+$ Conv., % | 4.6 | 32 | 91 | — | 32 | 91 |
| $C_9^+A$ Conversion, % | <1 | 42 | 90 | — | 42 | 90 |
| Reforming Conditions | | | | | | |
| Pressure, psig | — | 240 | 240 | — | 115 | 115 |
| $H_2$/HC ratio | — | 6.0 | 6.0 | — | 4.5 | 4.5 |
| Weight Space Velocity, $Hr^{-1}$ | — | 1.0 | 1.0 | — | 1.7 | 1.7 |
| $C_5^+$ Octane Severity, R + O | — | 100 | 100 | — | 100 | 100 |
| Integrated Process Performance | | | | | | |
| Process Yield, wt. % | | | | | | |
| $C_6A$ | 3.8 | 3.7 | 3.1 | 4.3 | 4.1 | 3.2 |
| $C_7A$ | 15.5 | 19.0 | 17.7 | 14.8 | 17.7 | 16.9 |
| $C_8A$ | 14.7 | 15.0 | 14.5 | 15.0 | 15.4 | 16.8 |
| $C_9^+A$ | 27.5 | 20.3 | 8.8 | 28.9 | 22.3 | 9.6 |
| Total BTX and EB Yield, wt. % | 34.0 | 37.7 | 35.3 | 34.1 | 37.2 | 36.9 |

Feed-B Naphtha

Catalyst-B was evaluated with Feed-B under the similar procedures described above for Feed-A. Results for the semi-regenerable reforming are summarized in Table 5 below. Catalyst-B achieved 42% $C_9^+$ aromatics conversion at 653° F. At these conditions, the integrated process produced more BTX and EB than the conventional HDS/reforming process. At more severe conditions, the total $C_6$–$C_8$ aromatics yield declined as observed previously.

TABLE 5

Performance of Catalyst-B Using Feed-B

| | HDS only | Catalyst-B | |
|---|---|---|---|
| Pretreater Performance | | | |
| Zeolite Temp., °F. | — | 653° F. | 726° F. |
| Process Yield, wt. % | | | |
| $C_6$ Cyclo-$C_5$ | 0.1 | 0.1 | 0.1 |
| Cyclo-$C_6$ | 1.7 | 1.7 | 0.6 |
| $C_6A$ | 1.1 | 1.1 | 0.9 |
| $C_7A$ | 2.5 | 2.7 | 2.8 |
| $C_8A$ | 5.1 | 4.8 | 5.1 |
| $C_9^+A$ | 20.3 | 10.9 | 8.8 |
| $C_9^+A$ Conversion, % | −10 | 41 | 2 |
| 300° F.$^+$ Conv., % | 2 | 39 | 69 |
| Integrated Process Performance | | | |
| Process Yield, wt. % | | | |
| $C_6A$ | 2.6 | 3.4 | 3.0 |
| $C_7A$ | 13.0 | 16.1 | 14.5 |
| $C_8A$ | 16.9 | 17.3 | 14.4 |
| Total BTX and EB Yield, wt. % | 31.9 | 34.5 | 24.6 |

In a preferred embodiment the invention provides a process integrated into the reformer section of a refinery for the manufacture of BTX and gasoline. The invention can improve the economics of meeting the benzene specification of the gasoline pool, preferably reducing the pool benzene content below 1% or 0.8%, while at the same time providing a stream which contains BTX and EB. This stream can be processed further to separate out benzene, toluene, xylenes and ethylbenzene components using conventional processes.

The present invention permits the processing of heavier naphtha due to enhanced back-end conversion. In addition, heavy FCC gasoline and coker heavy naphtha can be coprocessed with conventional naphtha. Both FCC and coker heavy naphtha are rich in heavy aromatics and can further increase BTX production. Because the invention can be carried out by simply replacing a downstream portion of conventional HDS catalyst in a pretreater reactor with porous inorganic oxide catalyst having pore openings of 12-member rings provides a relatively low capital cost method to increase heavier aromatic throughputs in a refinery.

It is claimed:

1. An integrated process for increasing $C_6$ to $C_8$ aromatics content in reformate prepared from $C_9^+$ aromatics-containing feed which comprises:

1) pretreating a raw naphtha feedstream containing $C_9^+$ aromatics and sulfur by contacting with a) a hydrodesulfurization catalyst under hydrodesulfurization conditions to produce a hydrodesulfurized feedstream and thereafter b) cascading said hydrodesulfurized feedstream over a porous crystalline inorganic oxide catalyst containing metal selected from the group consisting of noble metals and Group VIA metals, said catalyst comprising pores having openings of 12-member rings under conditions sufficient to effect conversion of $C_9^+$ aromatics, thereby providing a pretreated effluent stream of enhanced $C_8^-$ aromatics content relative to that obtained in the absence of said cascading; and 2) reforming at least a portion of said pretreated effluent stream to provide a reformate stream.

2. The process of claim 1 wherein step 1) is carried out in a single reactor.

3. The process of claim 1 wherein step 1 is carried out in two reactors.

4. The process of claim 1 further comprising stripping said pretreated effluent stream from step 1) to remove hydrogen sulfide, ammonia and $C_4^-$ hydrocarbons prior to step 2).

5. The process of claim 4 further comprising:

3) distilling said reformate stream to provide a $C_1$ to $C_4$ hydrocarbon-containing overhead stream, a $C_5$ hydrocarbon stream and a $C_6^+$ reformate bottoms stream;

4) extracting said $C_6^+$ reformate bottoms stream to provide a $C_6$ to $C_8$ aromatics-containing extract stream and a $C_6^+$ raffinate stream containing $C_6$ to $C_8$ non-aromatics and $C_9^+$ aromatics; and 5) combining said $C_5$ hydrocarbon stream with said $C_6^+$ raffinate stream to provide a gasoline boiling range product.

6. The process of claim 5 wherein said inorganic oxide catalyst comprises noble metal-containing zeolite having pores with openings of 12-member rings selected from the group consisting of zeolite beta, zeolite L, zeolite X, zeolite Y, Dealuminized Y, Ultrastable Y, Ultrahydrophobic Y, Si-Enriched Dealuminized Y, ZSM-12, ZSM-18, ZSM-20, mordenite and boggsite.

7. The process of claim 6 wherein said noble metal-containing zeolite comprising pores having openings of 12-member rings is zeolite beta.

8. The process of claim 7 wherein said inorganic oxide catalyst contains from 0.1 to 1 wt % noble metal selected from the group consisting of platinum, palladium, iridium, rhodium and ruthenium.

9. The process of claim 8 wherein said inorganic oxide catalyst contains from 0.3 to 0.7 wt % platinum.

10. The process of claim 7 wherein said inorganic oxide catalyst contains from 0.1 to 1 wt % metal selected from the group consisting of chromium, molybdenum, and tungsten.

11. The process of claim 7 wherein said inorganic oxide catalyst contains from 0.3 to 0.7 wt % molybdenum.

12. The process of claim 5 wherein said reforming is carried out in a continuous catalytic reformer (CCR).

13. The process of claim 5 wherein said reforming is carried out in a fixed bed reformer.

14. The process of claim 5 wherein said conversion of C9+ aromatics is no greater than 50%.

15. The process of claim 5 wherein said raw naphtha feed comprises heavy FCC gasoline.

16. The process of claim 5 wherein said raw naphtha feed comprises heavy coker naphtha.

17. The process of claim 5 wherein said raw naphtha feed contains at least 15 wt % $C_9^+$ aromatics.

* * * * *